United States Patent [19]

Klamer

[11] Patent Number: 4,932,676

[45] Date of Patent: Jun. 12, 1990

[54] ROLLER SKATE HAVING THREE CONTROL MODES

[75] Inventor: Reuben B. Klamer, Los Angeles, Calif.

[73] Assignee: Quaker Oats Company, Chicago, Ill.

[21] Appl. No.: 153,623

[22] Filed: Feb. 8, 1988

[51] Int. Cl.[5] ..... A63C 17/14

[52] U.S. Cl. ..... 280/11.2; 280/11.21; 74/578; 188/82.3; 188/82.4

[58] Field of Search ..... 280/11.2, 11.21, 87.04 R, 280/87.042; 188/1.12, 82.1, 82.2, 82.3, 82.7, 82.74, 265; 74/578

[56] References Cited

U.S. PATENT DOCUMENTS

| | | | |
|---|---|---|---|
| Re. 32,346 | 2/1987 | Klamer et al. | 280/11.2 |
| 1,230,491 | 6/1917 | Konietzky | 280/11.2 |
| 3,790,187 | 2/1974 | Radu et al. | 280/11.2 |
| 4,533,767 | 11/1985 | Robjent et al. | 280/11.21 |

*Primary Examiner*—Charles A. Marmor
*Assistant Examiner*—Richard Camby
*Attorney, Agent, or Firm*—Sherman O. Parrett

[57] ABSTRACT

A roller skate is provided having a body portion adapted to be attached to the foot of a wearer, and front and rear axles attached to the body portion, the axles having wheels mounted to the ends thereof. At least the front wheels are characterized by an outer cylindrical rolling portion having a plurality of teeth integrally formed on an inwardly facing circumferential surface thereof. A pawl member having first and second ratchet-engaging portions has a cam follower portion and is mounted by a camming member to the body of the skate. The camming member is movable between first, second and third positions. In the first position, the camming member acts through its cam follower portion to elevate the pawl member to a position where it does not engage any of the teeth on the inwardly facing surfaces of the front wheels. In the second position, the camming member allows the pawl to ride in the teeth by its own weight, establishing a ratcheting relationship permitting rotation of the wheels in only a single direction. In the third position, the camming member holds the pawl in the teeth formed in the front wheels so that the front wheels are restrained from moving in either direction.

10 Claims, 3 Drawing Sheets

ROLLER SKATE HAVING THREE CONTROL MODES

BACKGROUND OF THE INVENTION

This invention relates in general to roller skates and more particularly relates to a skate having a selectably-engagable mechanism for selecting the modes of wheel lock, rotation in only one direction, or free rotation in two directions.

It has long been recognized that the early stages of learning to roller skate are facilitated by providing a skate in which one or more of the wheels is prevented from turning in the rearward direction. By providing such a feature, a beginning skater may more easily learn to stop his forward motion without having to be concerned with the problem of thereafter beginning to roll backwards. Backward motion is considerably more difficult for a beginning skater to control than forward motion, and a skate having a forward only mode of operation is known to be useful. U.S. Pat. No. 4,553,767 to Robjent and Klamer and U.S. Pat. No. Re 32,346 to Klamer and Mortonson are examples of inventions intended to facilitate learning to roller skate by preventing one or more of the wheels from turning in the rearward direction.

In particular, U.S. Pat. No. 4,553,767 describes and claims a roller skate selectively switchable between a freewheeling mode in which all of the wheels are free to rotate in either direction and a unidirectional mode wherein at least one and preferably two wheels are inhibited from rotating in a rearward direction.

It has been determined that it would be useful in training beginning roller skaters to additionally be able to provide a roller skate that could be selectively actuated such that one or more wheels of the roller skate would not turn in either direction. For example, roller skating coaches often begin training children to roller skate by utilizing roller skates of the type having wheels secured to axles by nuts, and wherein the coach tightens the nuts to the point where the wheels will not rotate. However, a separate wrench is required to lock the wheels on such skates.

Enabling a beginning skater to stand on the roller skates without the wheels rotating inspires confidence in the beginning skaters and gets them accustomed to the feel of the skates and the weight of the skates on their feet. Locking one or more wheels of a skate also permits a beginning skater to feel secure on the skates and to get their first start at skating by walking on the skates. Being able to lock one or more wheels of a roller skate, especially without having to use a wrench, would also be useful to even advanced skaters, for example where it was desired to climb stairs with the roller skates.

The present invention relates to an improvement in the roller skate construction shown and described in U.S. Pat. No. 4,553,767. The skate described in that patent is one wherein the skate can be selectively actuated to perform in either of two modes, one being a freewheeling mode in which all of the wheels are free to rotate in either direction and the other being a unidirectional mode wherein at least one and preferably two of the wheels are inhibited from rotating in a rearward direction.

OBJECTS AND SUMMARY OF THE INVENTION

It is an object of the present invention to provide a roller skate selectively switchable between three different modes, one mode being having at least one but preferably two wheels locked against rotation in either direction, one mode being having at least one but prefer ably two wheels inhibited against rotation in a rearward direction, and the other mode being having all of the wheels free to rotate in either direction.

It is another object of this invention to provide such a skate wherein changing from any one of the modes to any other of the modes is easily accomplished without the necessity for disassembling any portion of the skate or even for removing the skate from the feet or shoes.

In accordance with a presently preferred embodiment of this invention, a roller skate is provided having a body portion adapted to be attached to the foot of a wearer, and front and rear axles attached to the body portion, the axles having wheels mounted to the ends thereof. At least the front wheels are characterized by an outer cylindrical rolling portion having at least one and preferably a plurality of teeth integrally formed on an inwardly facing circumferential surface thereof. A pawl member having first and second ratchet-engaging portions has a cam follower portion and is mounted by a camming member to the body of the skate. The camming member is movable between first, second and third positions. In the first position, the camming member acts through its cam follower portion to elevate the pawl member to a position where it does not engage any of the teeth on the inwardly facing surfaces of the front wheels. In the second position, the camming member allows the pawl to ride in the teeth by its own weight, establishing a ratcheting relationship permitting rotation of the wheels in only a single direction. In the third position, the camming member holds the pawl in the teeth formed in the front wheels so that the front wheels are restrained from moving in either direction.

Further objects and advantages of the present invention appear in the detailed description taken in conjunction with the accompanying drawings.

DETAILED DESCRIPTION

Figure 1:
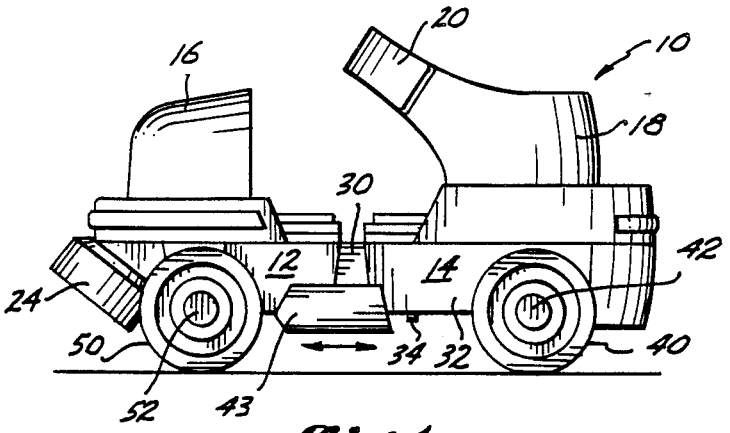
FIG. 1 is a side elevational view of a skate in accordance with this invention.

Referring now to FIG. 1, a skate 10 is illustrated having a forward body member 12 and a rearward body member 14. Body member 12 includes a cup shaped toe receiving upper portion 16 for engaging the toe portion of the foot of the wearer or of a shoe or boot worn by the wearer. Body member 14 includes a heel receiving upper portion 18 and a preferably integral strap 20 for securely attaching the shoe or foot of the wearer to the skate. Front and rear foot engaging upper portions 16 and 18 may be made of any flexible or relatively flexible material, such as plastic or leather, and strap 20 is preferably provided with a buckle or other releasable fastening means for allowing the skate to be comfortably adjusted to the foot of the wearer.

Figure 2:
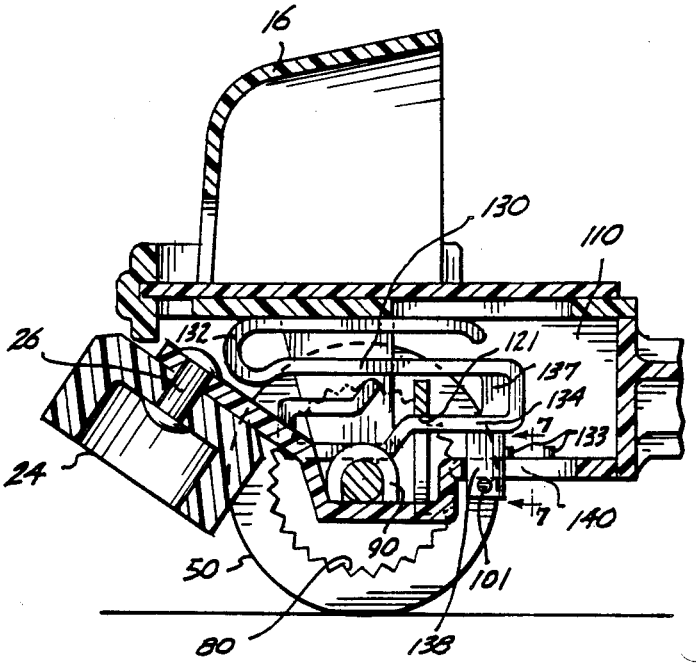
FIG. 2 is a section view of the front portion of the skate of FIG. 1 showing the components positioned for the free wheeling or bidirectional mode of operation.

Roller skate 10 may also include a conventional front stop member 24 attached to forward body member 12 by any conventional means such as a screw or rivet 26 or the like as illustrated in FIG. 2. A back stopper can also be provided.

Preferably, the spacing between front member 12 and rear member 14 of skate 10 is adjustable by providing a rearwardly extending rail portion 30 of front member 12 slidably-engaging a rail receiving portion 32 of rear member 14. Preferably, means such as an adjusting screw or button 34, are provided for releasing the tension between rail 30 and rail receiving portion 32 to allow the spacing between front member 12 and rear member 14 to be adjusted easily, but to maintain a preselected fixed relationship therebetween upon release of button 34. It will be appreciated that skates having adjustable spacing are known and as such, this feature of skate 10 forms no particular part of this invention.

Preferably, skate 10 includes a pair of rear wheels 40 attached to an axle 42 that is journaled in a conventional fashion to rear body portion 14 of the skate. A pair of front wheels 50 are attached to front axle 52 as more fully described hereinbelow. A selector slide 43 is positioned at one or both sides of the roller skate and can be translated to three different positions along the skate for selecting any one of the three different modes of operation of the skate. The manner in which the selector slide 43 is interconnected to other portions of the skate and functions to select the three different modes will become clear from the description of FIGS. 2 through 6.

Figure 4:
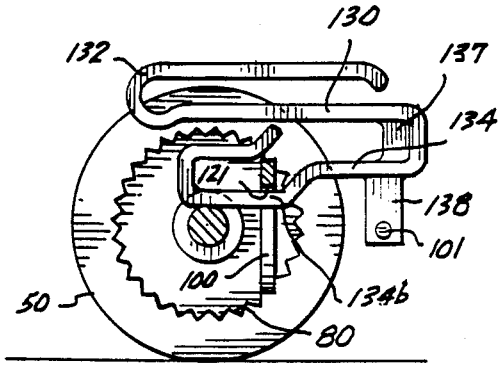
FIG. 4 is a pictorial view similar to FIG. 3 but showing the relationship between the wheel, camming member and pawl when they are positioned for the unidirectional mode in which the skate wheel is only free to rotate in one direction.
Figure 5:
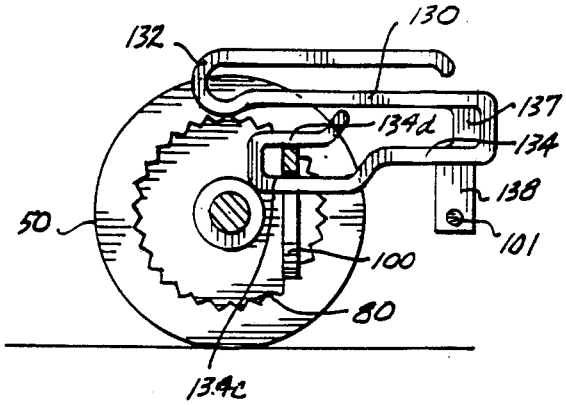
FIG. 5 is a pictorial view similar to FIGS. 3 and 4 but showing the relationship between the wheel, camming member and pawl when they are positioned for the full lock mode in which the skate wheel is prevented from rotating in either direction.
Figure 6:
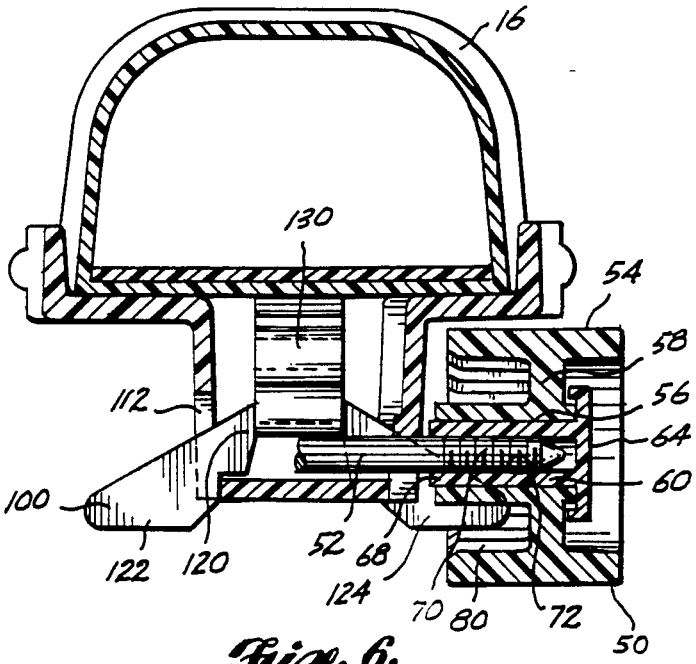
FIG. 6 is another sectional view of the skate of FIG. 1 showing the pawl element.
Figure 7:
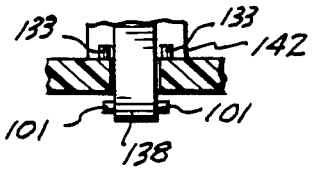
FIG. 7 is a sectional view taken along the line 7—7 of FIG. 2.

Turning now to a consideration of FIGS. 2 through 6, the operation of the three modes of the roller skate may be understood. Wheel 50, as best seen in FIG. 6, includes a cylindrical outer rolling portion 54 and a cylindrical inner portion 56 joined to outer portion 54 by washer-shaped web 58. An axle engaging bearing member 60, that preferably includes a decorative outer portion 64 and an inwardly-extending cylindrical axle-engaging portion 68, is disposed within inner portion 56 of wheel 50. Preferably, axle 52 is provided with means such as ridges or threads 70 on the surface thereof for providing a close interference fit with inner surface 72 of axle-engaging member 60. The inner cylindrical portion 56 of wheel 50 smoothly rotates on the outer surface of bearing member 60. Preferably, wheel 50 and bearing member 60 are made of compatible plastic materials requiring no lubrication at their bearing surfaces.

The inwardly facing surface of outer cylindrical rolling portion 54 of wheel 50 is provided with a plurality of gear like teeth 80 integrally formed therewith. In accordance with a presently preferred embodiment of this invention, wheel 50 is constructed of plastic or other suitable material, by molding or the like whereby the wheel can be formed in a single piece. Teeth 80 are preferably molded at the same time, although it will be appreciated that teeth 80 could be cut or otherwise machined into the inner surface of outer cylindrical portion 54 of wheel 50 in a separate operation. Preferably, axle 52 is journaled to forward body portion 12 by bearing 90 which may be integrally formed with forward body portion 12.

Front member 12 of skate 10 includes a hollow, generally rectangular inner chamber 110 disposed below and to the rear of upper portion 16. Referring particularly to FIG. 6, chamber 110 has first and second openings 112 and 114 (not visible) through the sidewalls thereof. Substantially V shaped pawl 100 comprises a central portion 120 and first and second outwardly extending ratchet-engaging wing portions 122 and 124. Wing portions 122 and 124 extend through openings 112 and 114 of chamber 120 and at least partially into the space between inner and outer cylindrical portions 54 and 56 of each of front wheels 50. Central portion 120 of pawl 100 includes cam follower surface 121 that rides on a cam surface of camming member 130 as will be more fully described below. Combination spring and camming member 130 is slidably disposed within chamber 110. Camming member 130 is shaped somewhat like an S, and includes an upper resilient portion 132 and a lower relatively rigid portion 134. The rigidity of lower portion 134 may be enhanced by a web of material 137 disposed in the bend of the lower portion 134. The lower portion 134 of camming member 130 has three cam surfaces, illustrated in the drawings as surfaces 134*a*, 134*b*, and 134*c*. Spring and camming member 130 is preferably made of metal or stiff plastic or the like and includes a tab 138 extending downwardly from member 130 through opening 140 in a lower wall of chamber 110 of forward body portion 12. The tab 138 itself may be utilized for actuating the spring and camming member 130 to its three different positions for the three different skate modes. Alternatively, a selector slide 43 as illustrated in FIG. I disposed at one or both sides of the skate 10 may be utilized for selecting the three different modes for the skate. In that event the selector slide 43 can be connected through a pin or rivet 101 or the like to the tab 138. By use of such side mounted selector slides 43 the skate modes can be changed while the skates are being worn, instead of having to turn the skates upside down in order to actuate the tab 138. This obviously is also much more efficient than requiring a separate wrench to e.g. tighten wheels to lock them.

Figure 3:
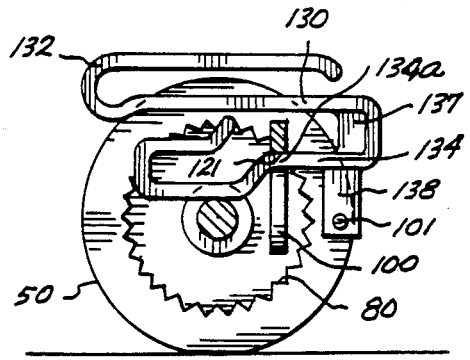
FIG. 3 is a pictorial view showing only a wheel, camming member and pawl of the skate of FIG. 1 when they are in their respective relationship as in FIG. 2 for the free wheeling mode such that the skate wheel is free to move in either direction.

FIGS. 3, 4 and 5 illustrate the three selectable positions of the camming member 130, in which the three respective camming surfaces 134*a*, 134*b*, and 134*c* respectively are aligned with the cam follower surface 121 of pawl 100. In the position of the camming member shown in FIG. 3, cam follower surface 121 of pawl 100 is elevated by cam surface 134*a* to the position shown, and wings 122 and 124 are kept out of engagement with teeth 80, so that wheel 50 is free to rotate in either direction.

When the camming member is displaced to its position illustrated in FIG. 4, the cam surface 134*b* is aligned with the pawl 100. The cam surface 134*b* is such that it is essentially disengaged from cam follower surface 121 of pawl 100. Wings 122 and 124 ride in ratchet teeth 80 biased into engagement therewith by the weight of pawl 100; and wheels 50 are prevented from rotating in a backwards direction.

When the camming member is displaced to the position illustrated in FIG. 5, the cam surface 134*c* is aligned with the pawl 100. In this case, the cam surface 134*c* is also essentially disengaged from cam follower surface 121 of pawl 100, with wings 122 and 124 biased into engagement with the ratchet teeth 80 by the weight of pawl 100. However, in this case a restraining portion 134*d* of camming member 130 is adjacent the upper end of pawl 100. While the pawl 100 is still held in engagement with the ratchet teeth 80 by its weight, the restraining portion 134*d* of the camming member prevents the pawl 100 from being displaced upwards as happens during the ratcheting action when the camming member is in the position shown in FIG. 4. Since the pawl 100 is held in position by the restraining portion 134*d*, it cannot be displaced upwards to ratchet. As a consequence, the pawl 100 remains in a locked condition in the ratchet teeth 80, and the wheel 50 is inhibited from moving in either direction.

Camming member 130 is maintained securely in a selected position by dogs 133 on the bottom wall of chamber 110 that engage projections 142 on the sides of tab 138. To change the position of camming member 130, a user pushes inwardly on tab 138 (through selector slide 43) so that projections 142 clear dogs 133, moves the tab to the desired position and releases the pressure on the tab whereby the member 130 is held securely in a selected position during skating.

While the invention has been described and illustrated with respect to a presently preferred embodiment thereof, it should be clearly understood that many variations and modifications to the preferred embodiment are within the skill of those working in this art without departing from the true spirit and scope of this invention.

I claim:

1. A roller skate which can be selectively actuated between three modes of no motion, unidirectional motion, and bidirectional motion, comprising:

a body;

a plurality of wheels attached to said body, at least one of said wheels having a cylindrical rolling portion including an inner surface surrounding a hollow inner chamber;

a plurality of ratchet teeth formed in said inner surface;

singular pawl means extending at least partially into said chamber;

means for selectively controlling movement of said singular pawl means between a first position disengaged from said teeth allowing bidirectional motion of said skate, a second position in which said singular pawl means is engaged with said teeth in a ratcheting relationship allowing unidirectional motion of said skate, and a third position in which said singular pawl means is engaged with said teeth and held in engagement therewith, to inhibit any motion of the skate.

2. The roller skate of claim 1 wherein said at least one wheel comprises an outer cylindrical portion, an inner cylindrical portion and a washer-shaped web joining said portions.

3. The roller skate of claim 2 wherein said teeth comprise teeth formed on the inner surface of said outer cylindrical portion.

4. The roller skate of claim 3 wherein said singular pawl means extends into the space between said inner and said outer cylindrical portions.

5. The roller skate of claim 1 wherein said singular pawl means comprises a substantially flat V-shaped member having a centrally disposed cam follower surface.

6. The roller skate of claim 5 comprising slidable cam means engaging said cam follower surface for selectably moving said singular pawl between said first, second and third positions.

7. The roller skate of claim 6 further comprising selector means attached to said cam means movable between first, second and third positions for positioning said singular pawl in said first, second and third positions, respectively.

8. The roller skate of claim 7 further comprising detent means for maintaining said cam means in any of said selected first, second and third positions.

9. A roller skate which can be selectively actuated between three modes of no motion, unidirectional motion, and bidirectional motion, comprising:

a body;

a plurality of wheel attached to said body, at least one of said wheels having at least one ratchet tooth associated therewith;

a singular pawl means;

mounting means mounting said singular pawl means with respect to said at least one ratchet tooth and for controlling movement of said mounting means between a first position wherein said singular pawl means is disengaged from said at least one ratchet tooth allowing bidirectional motion of said skate, a second position of said mounting means in which said singular pawl means is engaged with said at least one ratchet tooth in a ratcheting relationship allowing unidirectional motion of said skate, and a third position of said mounting means in which said singular pawl means is engaged with said at least one ratchet tooth and held in engagement therewith, to inhibit any motion of the skate.

10. A roller skate in accordance with claim 9 wherein a plurality of ratchet teeth are associated with said at least one of said wheels.

* * * * *